United States Patent [19]

Leszczak

[11] Patent Number: 4,927,067

[45] Date of Patent: May 22, 1990

[54] STAPLING MACHINE

[75] Inventor: John Leszczak, Roselle Park, N.J.

[73] Assignee: The Bates Manufacturing Company, Hackettstown, N.J.

[21] Appl. No.: 225,069

[22] Filed: Jul. 27, 1988

[51] Int. Cl.[5] ..... B25C 5/02

[52] U.S. Cl. ..... 227/128; 227/125

[58] Field of Search ..... 227/125–128

[56] References Cited

U.S. PATENT DOCUMENTS

| | | | |
|---|---|---|---|
| D. 182,772 | 5/1958 | Ruskin . | |
| D. 182,978 | 6/1958 | Ruskin . | |
| D. 187,509 | 3/1960 | Ruskin . | |
| D. 192,542 | 4/1962 | Crowle et al. . | |
| D. 192,543 | 4/1962 | Crowle et al. . | |
| D. 192,544 | 4/1962 | Crowle et al. . | |
| D. 234,937 | 4/1975 | Olney et al. . | |
| 2,279,584 | 4/1942 | Vogel | 227/126 |
| 2,717,382 | 9/1955 | Ruskin | 227/125 |
| 2,915,753 | 12/1959 | Ruskin . | |
| 3,103,012 | 9/1963 | Kohen et al. . | |
| 3,144,653 | 8/1964 | Kohen . | |

*Primary Examiner*—Frank T. Yost
*Assistant Examiner*—Rinaldi Rada
*Attorney, Agent, or Firm*—Weingram & Zall

[57] ABSTRACT

The present invention relates to a stapling machine which comprises: a stapling magazine for receiving staples which has a staple discharge opening at one end and a cover, pivotally mounted to the magazine at the other end. The cover is pivotally movable between a closed position overlying the magazine and an open position. A staple support is provided within the magazine which supports the staples therein. A follower is slidably mounted on the support for urging the staples toward the discharge opening. A spring urges the follower to slide toward the staple discharge opening. A detent is provided which coacts with the follower to prevent the follower from sliding toward the discharge opening when the cover is open. An actuator for releasing the follower from the detent when the cover is pivoted toward the closed position permits the follower to slide toward the discharge opening.

3 Claims, 5 Drawing Sheets

STAPLING MACHINE

BACKGROUND OF THE INVENTION

1. Field of the Invention

This invention relates to stapling machines and improvements therein. In particular, this invention relates to a unique mechanism which prevents the jamming of staples in a desk stapler and prevents the stapler from "snapping" closed prematurely.

2. Discussion of the Prior Art

Stapling machines, particularly desk staplers, are well known in the art, see, for example, U.S. Pat. Nos. 3,144,653, 3,103,012 and 2,915,753 as well as Design Pat. Nos. 182,772, 182,978, 187,509, 192,542, 192,543, 192,544 and 234,937. All of these patents are incorporated herein by reference.

A particular problem associated with staplers, particularly desk staplers that have open channel loading, is that when the cover to the staple magazine is opened and staples are inserted on the rail or support means for the staples, upon initiation of closure of the cover, the follower means, which urges the staples to the discharge opening, proceeds rapidly down the rail, causing the staples to lift off the rail resulting in jamming of the stapler. Additionally, when placing staples in the magazine the cover of most conventional staplers has a tendency to "snap" to the closed position due to the tension placed on the cover by the spring mechanism. Such unexpected closure can cause malfunctioning of the stapler, e.g. jamming of staples, and even minor injuries.

OBJECTS AND SUMMARY OF THE INVENTION

It is an object of this invention to provide a stapler having a unique safety mechanism which minimizes the possibility of the stapler cover snapping shut while loading staples.

It is another object of this invention to provide a stapler which has a reduced chance of malfunctioning due to staple jamming.

It is yet another object of this invention to provide a stapler having a unique spring loaded mechanism which allows the stapler to self adjust in order to avoid staple jamming even when the stapler is used improperly.

It is still another object of this invention to provide a stapler having a means for safer opening and closing.

It is a further object of this invention to provide a stapler wherein when the cover to the magazine is pivoted to the closed position, the staples therein remain properly seated and do not lift off of the support rail of the magazine.

It is still a further object of this invention to provide a stapler wherein the cover is closed prior to having the follower slide along the rail to urge the staples forward to the discharge opening.

All of the foregoing objects are achieved by the stapling machine of this invention. The stapler comprises a staple magazine for receiving staples which has a staple discharge opening at one end, i.e. the front end, and a cover, pivotally mounted to the magazine at the other end, i.e. the rear end. The cover is pivotally movable between a closed position overlying the magazine and an open position. A staple support means, e.g. rail, is provided within the magazine to support the staples therein. A follower is slidably mounted on the support for urging the staples toward the discharge opening. A spring, secured to both the cover and the follower, urges the follower to slide toward the staple discharge opening upon closure of the cover and away from the discharge opening upon opening the cover, as well as urging the cover closed. A detent means is provided, preferably within the magazine at the rear, which coacts with the follower to prevent the follower from sliding toward the discharge opening. An actuator, preferably within the cover, coacts with the follower to release the follower from the detent at a predetermined position as the cover is pivoted to the closed position, thereby permitting the follower to slide toward the discharge opening. Preferably the follower is released from the detent means when the cover is substantially closed.

BRIEF DESCRIPTION OF THE DRAWINGS

Other important objects and functional and structural features of the invention will be apparent from the following detailed description taken in conjunction with the accompanying drawings, wherein.

DETAILED DESCRIPTION OF THE INVENTION

Figure 1:
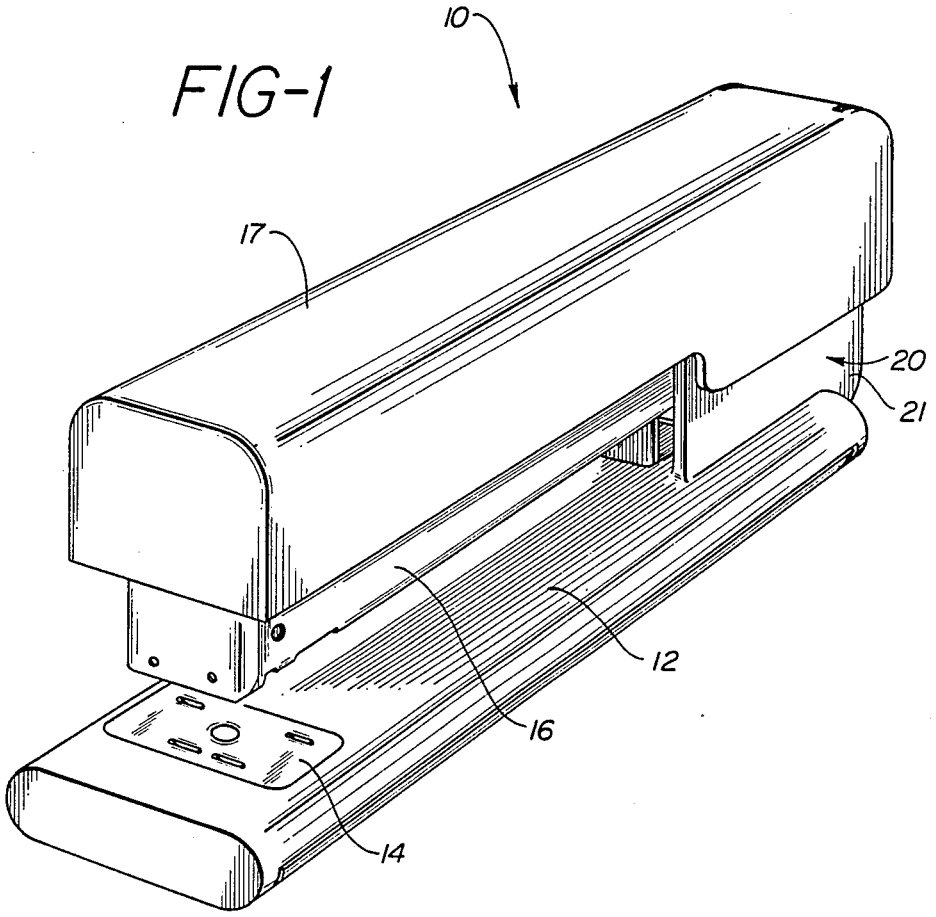
FIG. 1 is a perspective view of the stapling machine of this invention.
Figure 2:
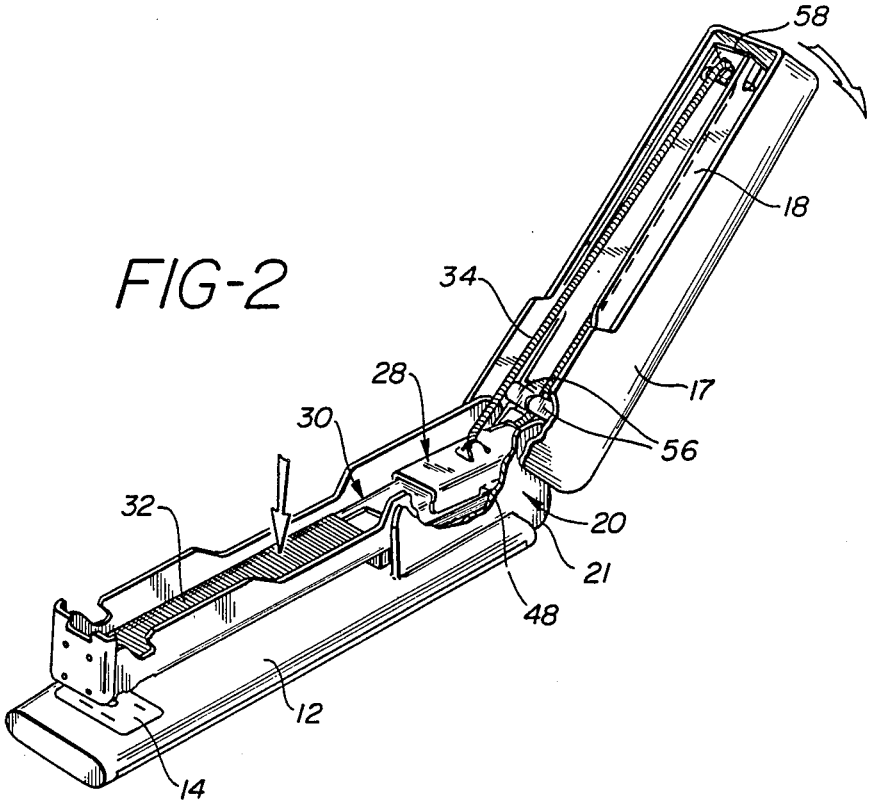
FIG. 2 is a perspective view of the stapling machine of this invention wherein the cover to the magazine is being pivoted to an open position.
Figure 3:
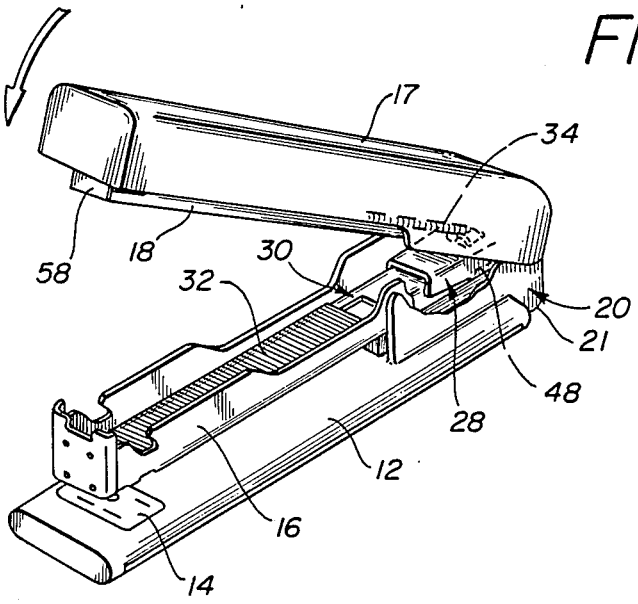
FIG. 3 is a perspective view of the stapling machine of this invention wherein the cover to the magazine is being pivoted to the closed position.

Referring to the drawings, and in particular to FIGS. 1–4, the stapling machine 10 of this invention has a base 12 and at one end thereof an anvil 14. A magazine 16 (for staples 32) and cover 18 and cap 17 therefor are each pivotally supported on support 20 at the rear end of the base 12 opposite the anvil 14. The base 12 and anvil 14 thereon are functionally conventional, preferably both being made of formed metal, e.g. steel. The magazine 16, cap 17 and cover 18, except for modifications made therein for proper functioning and coaction in this invention, are functionally conventional, preferably all being made of formed metal, e.g. steel, with the cap being made of a hard plastic.

Support 20 has a pair of upwardly extending lateral legs 21. Referring to FIGS. 4–7, a pin 26 pivotally connects cap 17, cover 18 and magazine 16 in support 20, the pin 26 passing through holes 22 of support legs 21, holes 24 of magazine 16, and holes 59 of cover 18. The ends of pin 26 lock into the inside of cap 17. A leaf spring (not shown) is secured to the base 12 and removably positions the magazine 16 to the base.

Referring to FIGS. 2–4 and 7, the magazine 16 has a longitudinally disposed rail 30 therewithin. A follower 28 is slidably disposed upon rail 30 and has a hook portion 36 on the top wall 66. Two side walls 68 extend downward therefrom, each having a lip 70 thereon (see FIG. 7). Rail 30 supports staples 32 loaded into magazine 16. Rail 30 has a top wall 64 and two side walls 62 extending down therefrom. A staple discharge opening (not shown) is provided at the end of magazine 16. A coil spring 34 having an eyelet 35 at one end is secured to hook 36 on follower 28. Spring 34 passes over movable roller 38 which is slidably movable within slots 40 in the front of magazine cover 18. Movable roller 38 has thereon lateral extensions 44 which are adapted to engage with slots 46 at the end of magazine 16 when cover 18 is closed. The other end of spring 34 passes between the side walls of cover 18 and attaches to hook 42 at the rear of cover 18.

Spring 34 provides tension on follower 28 urging it along rail 30. When the stapler cover 18 is being opened, see FIG. 2, spring 34 urges the follower 28 away from the discharge opening toward the rear, and when stapler cover 18 is being closed, see FIG. 3, spring 34 urges the follower 28 towards the discharge opening. Spring 34 also provides a lifting force to follower 28 to maintain lips 70 of follower 28 in contact with the edges of rail side walls 62 while follower 28 slides thereon. Spring 34 also provides tension on roller 38 so that when the cover 18 is closed, lateral extensions 44 of roller 38 are maintained in slots 46 to maintain the cover 18 closed. Spring 34 also urges cover 18 to the closed position.

Rail 30 fits within magazine 16 and is preferably held therein by clips and spring means (not shown). There is a space between the inner side walls of magazine 16 and side walls 62 of rail 30 sufficient to permit staples 32 and follower 28 to slide or ride on rail 30. Rail 30 has near the rear end thereof a shoulder 48 which functions as a detent means for follower 28. When cover 18 is being closed, follower 28 is provided with a lifting force by spring 34, as well as a force sufficient to urge it toward the discharge opening. This causes front surfaces 72 of lips 70 of follower 28 to engage shoulder 48 to retain the follower 28 at shoulder 48 so as to inhibit its forward movement.

Cover 18 is adapted to fit within magazine 16 and has at the front thereof slots 40 for roller 38 to ride therein. At the rear end of cover 18, holes 50 are provided which align with holes 24 of the magazine and holes 22 of the support so that pin 26 can pass therethrough.

Figure 4:
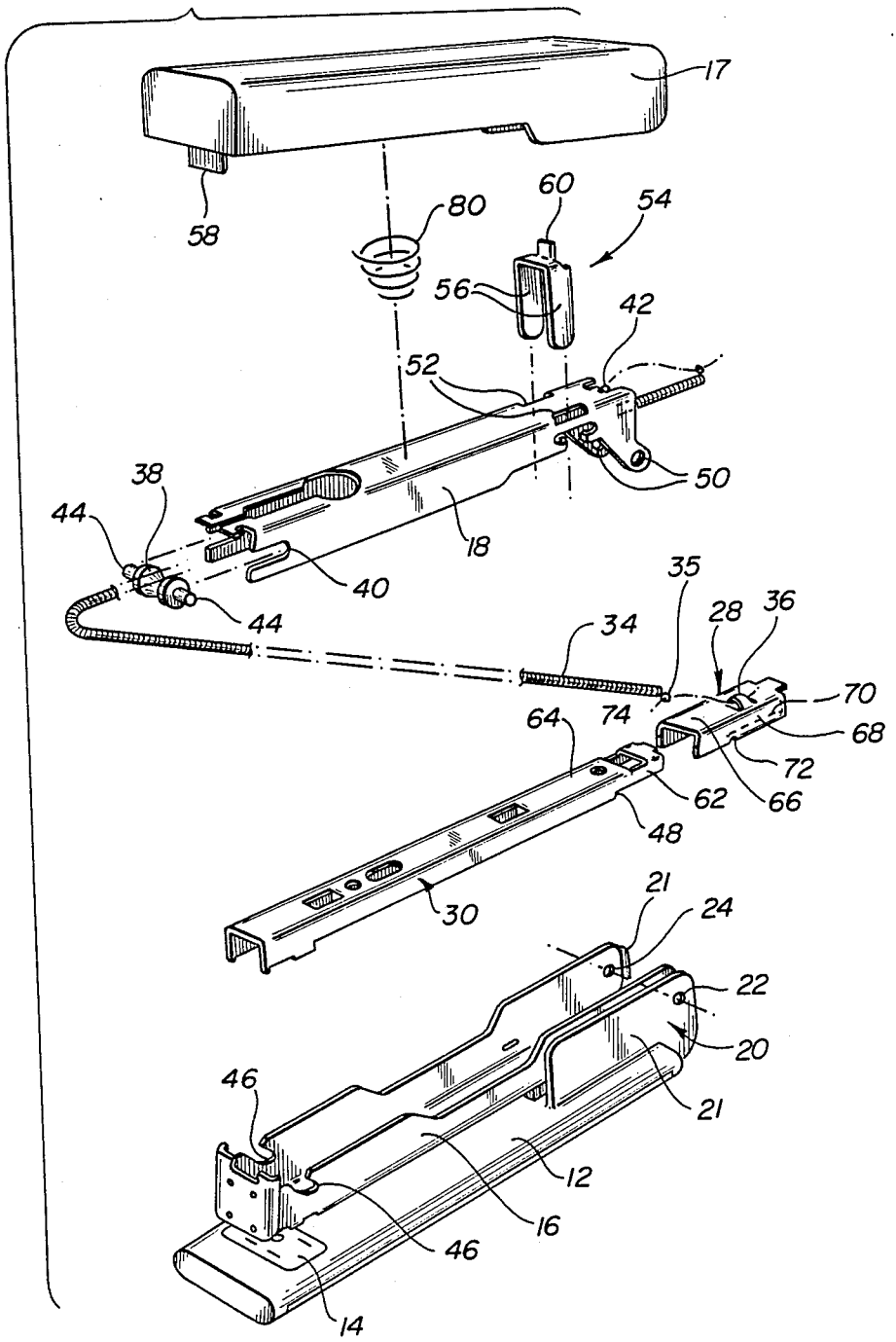
FIG. 4 is an exploded perspective view of the stapler of this invention.

Referring to FIG. 4, the rear of cover 18 is further provided with two slots 52 on the top thereof. Slidable actuator 54 is provided with two fingers 56 thereon and toe 60 at the top. The fingers 56 slidably engage with slots 52. The cap 17 pivotally engages to the ends of pin 26 at the interior thereof. Cap 17 fits over cover 18 and has therein a driver blade 58 for driving staples 32 through the staple discharge hole. A spring 80 bears against the inside of cap 17 and the top of cover 18 to springably retain cap 17 away from cover 18.

Referring to FIGS. 4–7, toe 60 is of a length such that when the cover 18 is in the substantially closed position, toe 60 is pushed downward by cap 17 and fingers 56 coact with follower 28 to force follower 28 downward causing it to release from shoulder 48. This permits follower 28 to slide along rail 30 to urge staples 32 toward the discharge opening, the staples 32 being urged forward by surface 74 of follower 28.

Figure 5:
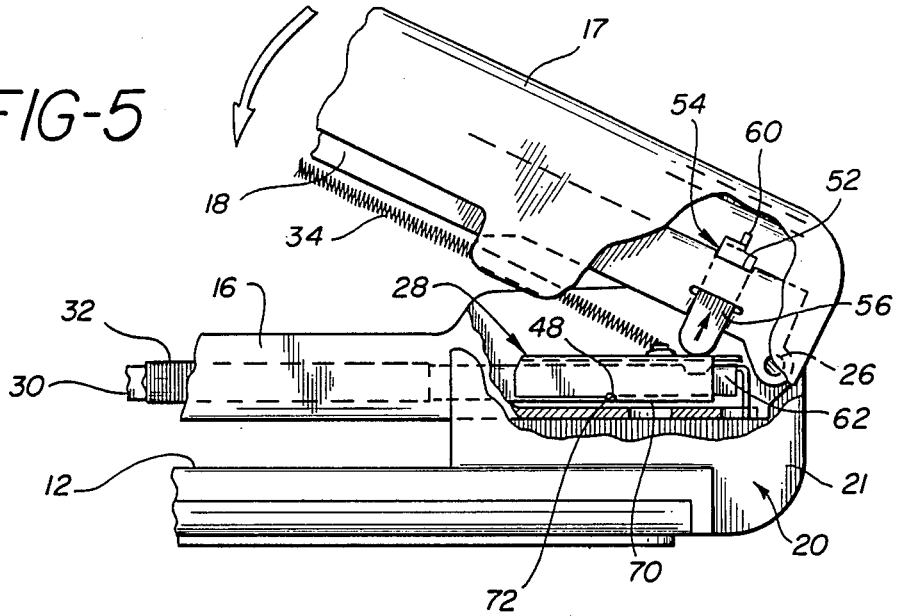
FIG. 5 is a fragmentary sectional side view of the stapler of this invention in an open position and being pivoted to a closed position.
Figure 6:
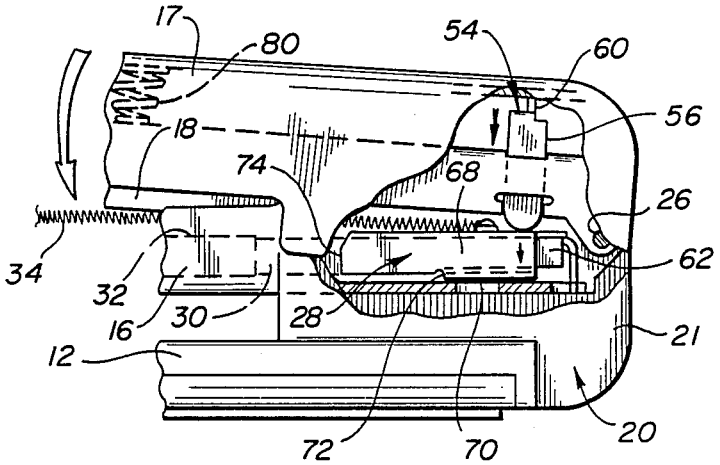
FIG. 6 is a fragmentary sectional side view of the stapler of this invention just prior to being pivoted to the closed position.
Figure 7:
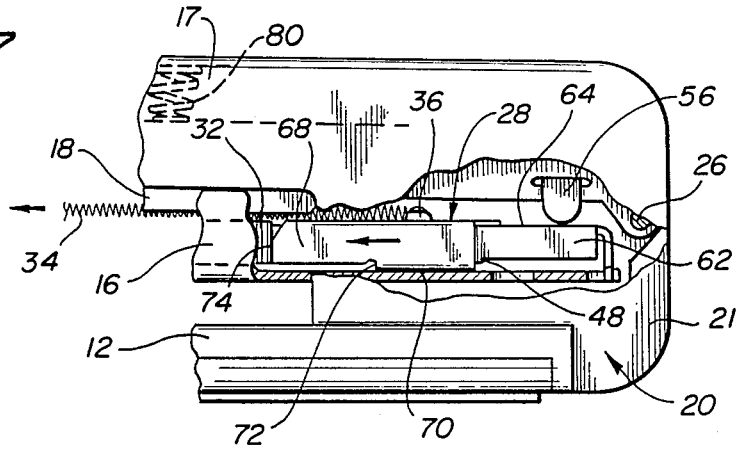
FIG. 7 is a fragmentary sectional view of the stapler of this invention in the closed position.
Figure 8:
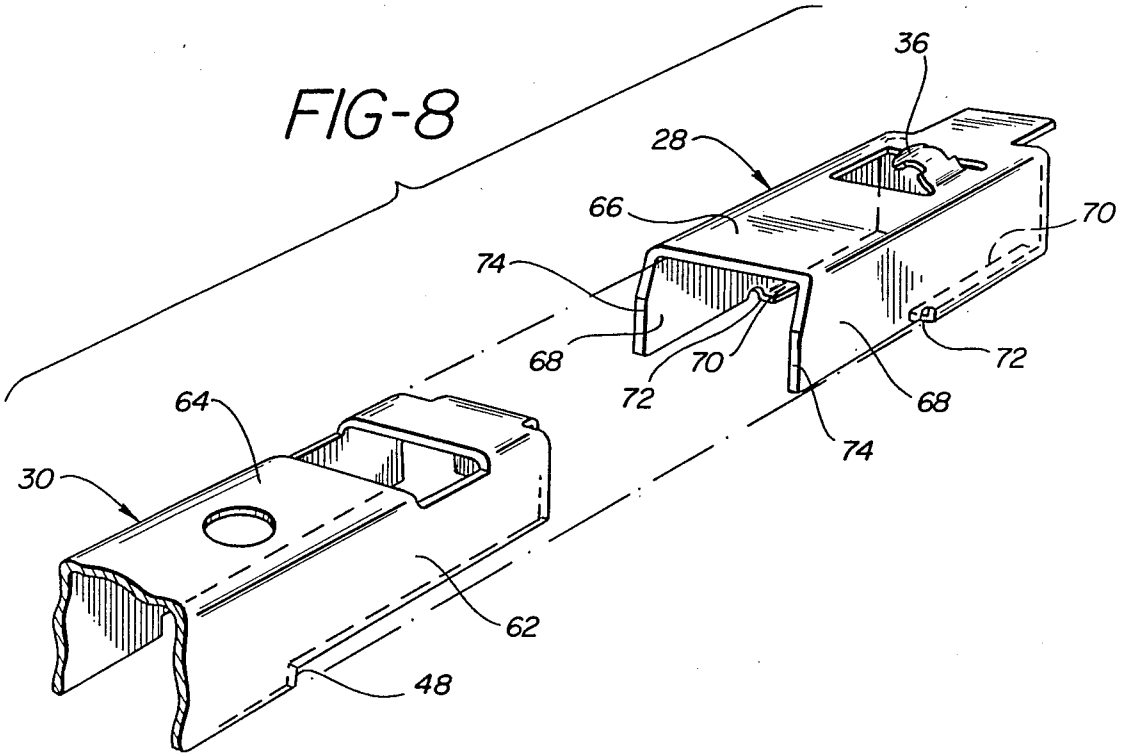
FIG. 8 is a fragmentary exploded perspective view of a portion of the rail 30 for supporting the staples and the follower 28 used in the stapler of this invention.

The function of this invention can be seen more clearly in FIGS. 5–7. In FIG. 5, the cover 18 and cap 17 are in the open position but being urged toward the closed position. Spring 34 urges follower 28 forward and upward causing surface 72 of lip 70 of follower 28 to engage shoulder 48 (see FIG. 7). At this point, the actuator 54 is being raised by engagement of fingers 56 with the top 66 of follower 28. Toe 60 is disengaged from cap 17.

Referring to FIG. 6, as cap 17 and cover 18 are pivoted closed, the ends of fingers 56 of actuator 54 contact follower 28 to cause toe 60 to move toward and engage the interior surface of cap 17. At a predetermined point, preferably when roller 38 engages slots 40 and the cover 18 is substantially closed to maintain the staples 32 in position on rail 30, toe 60 coacts with the interior of cap 17 and is forced downward so that it pushes the follower 28 down causing disengagement of surface 72 of follower 28 from shoulder 48. Spring 34 immediately urges the follower forward urging the staples toward the discharge opening by surface 74 of follower 28.

The fact that spring 34 is attached to follower 28 while it is retained at the rear of the stapler 10 tends to decrease the closing force on stapler cover 18 thus causing a decrease in the chances that the cover will prematurely "snap" closed causing jamming or injury.

The assembly of this invention from the component parts and the operation of the stapling machine of this invention by the operator is conventional and need not be described. However, it is pointed that this invention has the advantage of having staples securely placed therein without being accidentally lifted from the railing device prior to closure of the magazine and prevents the accidental "snapping" of the cover closed.

The foregoing specific embodiment of the instant invention as set forth in the specification herein are for illustrative purposes only. Various changes and modifications may be made within the spirit and scope of this invention.

What is claimed is:

1. A stapling machine comprising:

a staple machine for receiving staples, having a staple discharge opening at one end;

a cover pivotally mounted to the magazine at the other end, pivotally movable between a closed position overlying the magazine and an open position;

a cap mounted a distance from the cover and pivotally movable therewith;

a staple supporting means within the magazine for supporting staples therein comprising a rail having a top wall and two side walls;

a follower means slidably mounted on the supporting means for urging staples toward the discharge opening;

a spring means secured to the cover and to the follower means for urging the follower to slide away from and toward the staple discharge means and to urge the cover closed;

detent means within the magazine coacting with the follower to prevent the follower means from sliding toward the discharge means when the cover is open, said detent means comprising a shoulder in a side wall of the rail;

wherein the follower comprises a top wall having two side walls, at least one wall having a lip thereon which coacts with the shoulder;

an actuator means mounted to the cover coacting with the follower to release the follower from the detent means when the cover is pivoted to a substantially closed position thereby permitting the follower to slide toward the discharge opening;

wherein the actuator means coacts with the cap to release the follower when the cover is in a substantially closed position; and wherein the actuator comprises a stirrup having two fingers and a toe thereon, the fingers slidably mounted in the cover and adapted to coact with the follower and the toe adapted to coact with the cap.

2. A stapling machine comprising:

a staple magazine for receiving staples, having a staple discharge opening at one end;

a cover pivotally mounted to the magazine at the other end, pivotally movable between a closed position overlying the magazine and an open position;

a cap mounted a distance from the cover and pivotally movable therewith;

a staple supporting means within the magazine for supporting staples therein comprising a rail having a top wall and two side walls;

a follower means slidably mounted on the supporting means for urging staples toward the discharge opening;

a spring means secured to the cover and to the follower means for urging the follower to slide away from and toward the staple discharge means and to urge the cover closed;

detent means within the magazine coacting with the follower to prevent the follower means from sliding toward the discharge means when the cover is open, said detent means comprising a shoulder in a side wall of the rail;

wherein the follower comprises a top wall having two side walls, at least one wall having a lip thereon which coacts with the shoulder;

an actuator means mounted to the cover coacting with the follower to release the follower from the detent means when the cover is pivoted to a substantially closed position thereby permitting the follower to slide toward the discharge opening;

wherein the actuator means coacts with the cap when the cover is pivoted to a predetermined point toward the closed position to release the follower; and wherein the actuator comprises a stirrup having two fingers and a toe thereon, the fingers slidably mounted in the cover and adapted to coact with the follower and the toe adapted to coact with the cap.

3. A stapling machine comprising:

a staple magazine for receiving staples, having a staple discharge opening at one end;

a cover pivotally mounted to the magazine at the other end, pivotally movable between a closed position overlying the magazine and an open position;

a cap mounted a distance from the cover and pivotally movable therewith;

a staple supporting means within the magazine for supporting staples therein;

a follower means slidably mounted on the supporting means for urging staples toward the discharge opening;

a spring means secured to the cover and to the follower means for urging the follower to slide away from and toward the staple discharge means and to urge the cover closed;

detent means coacting with the follower to prevent the follower means from sliding toward the discharge means when the cover is open;

an actuator means mounted to the cover coacting with the follower to release the follower from the detent means when the cover is pivoted to a substantially closed position thereby permitting the follower to slide toward the discharge opening;

wherein the actuator means coacts with the cap when the cover is pivoted to a predetermined point toward the closed position to release the follower; and wherein the actuator comprises a stirrup having a finger and a toe thereon, the finger slidably mounted in the cover and adapted to coact with the follower and the toe adapted to coact with the cap.

* * * * *